United States Patent [19]

Schwemin et al.

[11] Patent Number: 5,050,523

[45] Date of Patent: Sep. 24, 1991

[54] PIVOTED VEHICLE LAUNCH FOR SUBMARINE

[75] Inventors: John A. Schwemin; Richard H. Baker, both of Middletown; James M. Sowle, Portsmouth; Stephen A. Jordan, Narragansett, all of R.I.

[73] Assignee: The United States of America as represented by the Secretary of the Navy, Washington, D.C.

[21] Appl. No.: 599,558

[22] Filed: Oct. 17, 1990

[51] Int. Cl.[5] ..... B63B 35/44

[52] U.S. Cl. ..... 114/259; 114/322

[58] Field of Search ..... 114/258, 259, 260, 263, 114/312, 322, 325, 242, 248, 244, 365

[56] References Cited

U.S. PATENT DOCUMENTS

| | | | |
|---|---|---|---|
| 1,113,450 | 10/1914 | Laurenti | 114/259 |
| 1,336,287 | 4/1920 | Dorffel | 114/322 |
| 1,842,572 | 1/1932 | Strauss | 114/325 |
| 2,319,855 | 5/1943 | Forsberg | 114/259 |
| 3,536,023 | 10/1970 | Toher et al. | 114/259 |

FOREIGN PATENT DOCUMENTS

| | | | |
|---|---|---|---|
| 2186547 | 8/1987 | United Kingdom | 114/259 |

*Primary Examiner*—Sherman Basinger

*Assistant Examiner*—Stephen P. Avila

*Attorney, Agent, or Firm*—Michael J. McGowan; Prithvi C. Lall; Michael F. Oglo

[57] ABSTRACT

The launching of a vehicle having front and back ends, from the submerged hull of a vessel that is moving forward through water by allowing the vehicle to pivot outboard clear of the hull, preferably from a launchway cavity, into the flow stream where it is released to move under its own propulsion and/or buoyancy forces. A first mechanism is carried on a submerged exterior surface of the hull and connected to the front portion of the vehicle, for initially supporting the vehicle front portion adjacent to the hull in the direction of hull travel, and then selectively releasing the front portion of the vehicle from the hull so that the front portion can move laterally away from the hull into the flow stream. A second mechanism is connected between the hull and the back portion of the vehicle, for initially providing stationary support to the back portion of the vehicle adjacent to the hull while the first mechanism supports the front portion, and then providing pivoting support to the back portion as the vehicle front portion thereby swings away from the hull. Structure is provided to cooperate with the first mechanism, for urging the front portion of the vehicle laterally away from the hull as the front portion is released by the first mechanism.

13 Claims, 4 Drawing Sheets

PIVOTED VEHICLE LAUNCH FOR SUBMARINE

STATEMENT OF GOVERNMENT INTEREST

The invention described herein may be manufactured and used by or for the Government of the Unites States of America for governmental purposes without the payment of any royalties thereon or therefor.

BACKGROUND OF THE INVENTION (1) Field of the Invention

The present invention relates to the launching of vehicles from the submerged hulls of vessels, and more particularly, to the launching of vehicles such as torpedoes, missiles, mines, countermeasures and autonomous underwater vehicles (AUV's), from the hull of a submarine.

(2) Description of the Prior Art

Conventionally, vehicles such as torpedoes, missiles, mines, or countermeasures (hereafter called vehicles) are launched from a submarine hull through a torpedo or launch tube. The launching imparts longitudinal motion of the vehicle through the tube, which carries the vehicle down the tube and out of the submarine hull form into the water flow stream outside the moving hull.

In general, the vehicle is launched either obliquely against, or normal (perpendicular) to, the flow stream outside the moving hull. In order for the vehicle to clear the hull, it is propelled initially by pumped water or compressed air introduced behind the vehicle in the tube. A significant amount of energy with consequent acoustic noise generation, is associated with the launch. Not only does the conventional launch technique create significant acoustic noise, but the ejection system requires substantial volume and weight allowances internal to the submarine.

Because the vehicle is constrained by the launch tube walls from freely reacting to the hydrodynamic force due to the flow field (which urges the vehicle to yaw and translate off the launch tube axis), the vehicle can experience damage from impact and varying loads while riding on or hitting against the launch tube wall. Also, the resulting disruption to the intended trajectory can prevent the vehicle from stabilizing after launch. Moreover, vehicle designs are limited to configurations and geometries that can interface with, and accommodate contact against, the tube during launch. In many cases, the submarine speed related launch envelope is restricted to prevent damage to the vehicle or to insure controllability.

SUMMARY OF THE INVENTION

It is, accordingly, an object of the present invention to quietly and efficiently launch vehicles, particularly torpedoes, missile, mines, countermeasures and AUV's from submerged hulls, particularly submarine hulls.

This is accomplished by allowing the vehicle to pivot outboard clear of the hull, preferably from a launchway cavity, into the flow stream where it is released to move under its own propulsion and/or buoyancy forces.

In a general sense, the invention is directed to a system and method for launching a vehicle having front and back ends, from the submerged hull of a vessel that is moving forward through water. A first mechanism is carried on a submerged exterior surface of the hull and connected to the front portion of the vehicle, for initially supporting the vehicle front portion adjacent to the hull in the direction of hull travel, and then selectively releasing the front portion of the vehicle from the hull so that the front portion can move laterally away from the hull into the flow stream. A second mechanism is connected between the hull and the back portion of the vehicle, for initially providing stationary support to the back portion of the vehicle adjacent to the hull while the first mechanism supports the front portion, and then providing pivoting support to the back portion as the vehicle front portion thereby swings away from the hull. Structure is provided to cooperate with the first mechanism, for urging the front portion of the vehicle laterally away from the hull as the front portion is released by the first mechanism. The vehicle is released from the second mechanism, and thereby launched from the hull, either under its own propulsion power, or from the momentum as a result of the forward motion of the vessel.

Preferably, the hull includes a launchway formed as a cavity external to the pressure hull, and large enough to receive completely the vehicle as supported by the first and second mechanisms.

In one embodiment, the structure for urging the front portion laterally away from the hull is in the form of an inlet channel forward of the launch cavity. The channel produces a vigorous flow of water between the cavity wall and the front portion of the supported vehicle. In another embodiment, the functionally equivalent structure is in the form of a piston or a pneumatic or hydraulically operated arm for moving the first mechanism in a direction outboard of the cavity, before release.

The launch system and method in accordance with the invention uses significantly less energy than conventional techniques, because only pivoting motion to the vehicle needs to be developed. Hydrodynamic forces present as a result of the vessel's forward way, provide the bulk of this energy.

Because the vehicle is positively controlled and restrained to motion in the pivoting plane during launch, yet is free to move in response to the hydrodynamic forces acting on it, there is no chance for damage to the vehicle. The vehicle external configuration is virtually unrestricted with the exception of providing appropriate interface to the pivoting mechanism.

With the present launch method, the typical torpedo launch pump with its associated weight and volume requirements, is eliminated. This affords more vehicle storage room, or the option of a smaller submarine having the same weapon stowage as a larger conventional submarine.

The invention is compatible with the launch of vehicles stowed external to the pressure hull in the free-flood spaces of the submarine, or stowed internal in a torpedo room from which a transfer tube would be utilized to position vehicles into a launch cavity external to the pressure hull.

BRIEF DESCRIPTION OF THE DRAWINGS

These and other objects and advantages of the invention will be evident from the accompanying description of the preferred embodiments, taken with reference to the accompanying drawings, in which.

DESCRIPTION OF THE PREFERRED EMBODIMENT

Figure 1:
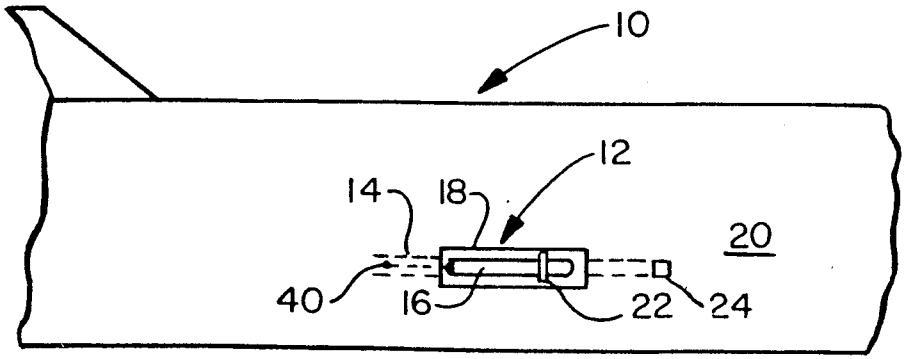
FIG. 1 is a side elevation view of a portion of the hull of a submarine, showing a vehicle launch area.

FIG. 1 shows a submarine hull 10 and region 12 where vehicles may be launched in accordance with the present invention. This hull region 12 has a transfer tube 14 through which each vehicle 16 is delivered from stowage internal to the hull to a position in a launch cavity 18 formed as a recess in the hull 20. Preferably the launch cavity 18 is deep enough so that the vehicle 16, as supported therein, remains within the overall envelope of the hull 20.

In accordance with the invention, the vehicle 16, once positioned and secured by one or more mechanisms 22 in the cavity wall, is launched according to the following sequence. First, the vehicle 16 is pivoted outboard of the cavity 18 and hull 20, into the flow stream passing over the hull, and secondly, it is released and carried outboard away from the submarine hull due to the hydrodynamic forces and forward momentums to the submarine's forward motion through the water. In the first and second embodiments to be described below, the first step of pivoting the vehicle outboard of the cavity, is accomplished by an active mechanism 22, under hydraulic, or similar mechanical action. In the third and fourth embodiments described below, the pivoting of the vehicle is accomplished passively by a flow of water that is delivered through a channel 24 formed in the hull forward of the cavity 18. This delivers a vigorous flow of water between the cavity wall and the forward portion of the vehicle, producing an outward pivoting force on the vehicle. With all embodiments, a door preferably covers the launch cavity 18 during normal submarine maneuvers, but is retracted to expose the cavity preparatory to the launch mode of operation.

Figure 2:
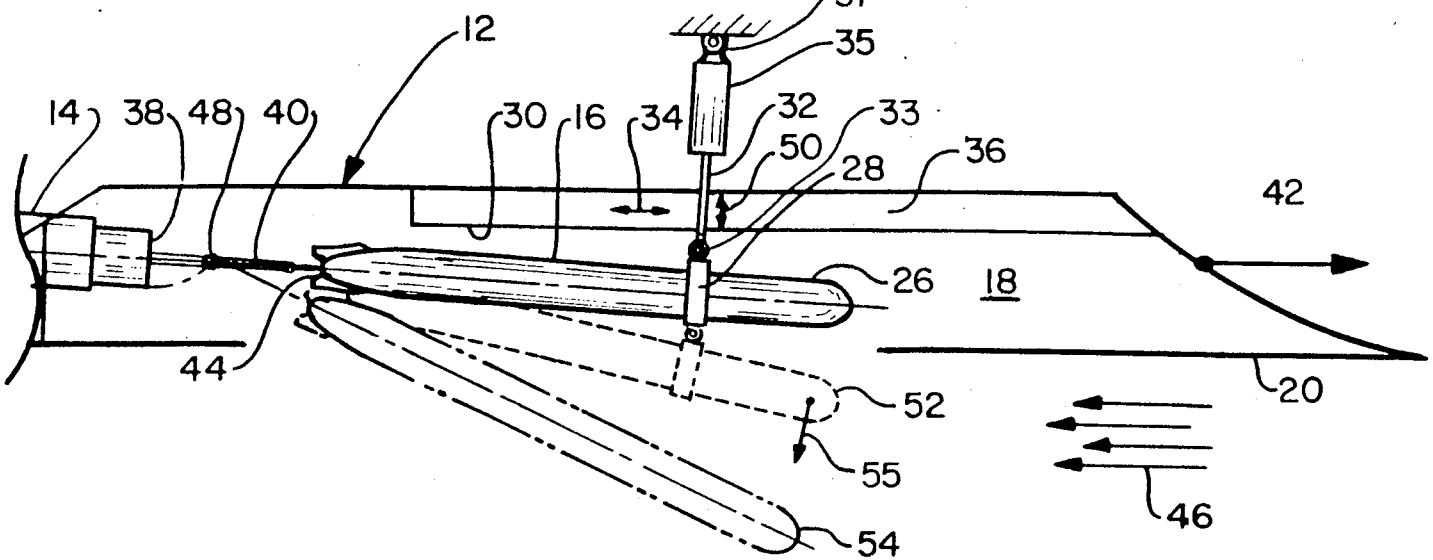
FIG. 2 is a plan view of the first embodiment of the invention, wherein an hydraulic or pneumatic operated arm with release clamp displaces the forward end of the vehicle outboard into the external flow stream, in cooperation with a pivot mechanism on the ram of the back end of the vehicle, until the vehicle is sufficiently clear of the hull to initiate self-propulsion.

FIG. 2 is a diagrammatic view of the vehicle launch region 12 of the hull looking downward in the view of FIG. 1. The vehicle 16, is advanced through the transfer tube 14 so that the forward portion 26 passes through a ring 28 or similar clamp which is supported through the wall 30 of the launch cavity 18. The clamp 28 is pivotally supported at 33 on an arm 32 which is connected to a piston and hydraulic or pneumatic cylinder 35. The cylinder 35 is pivotally connected as shown at 37, for movement substantially in the plane of the sheet of drawing. Thus, the arm mechanism 32 is adapted to move in the longitudinal direction 34 of the cavity, between a first position, at the left-most portion pressure box 36, to the forward-most position shown in FIG. 2. This enables the clamp 28 to be in a position near the exit 38 of the tube 14, for clamping and maintaining support on the front portion 26 of the vehicle 16 as the transfer tube ram 40 pushes the vehicle out of and beyond the tube exit 38.

Thus, in the armed mode, the embodiment of FIG. 2 has a first mechanism 28 carried on a submerged exterior surface of the hull and connected to the front portion 26 of the vehicle for supporting the front portion adjacent to the hull in the direction 42 of hull travel. A second mechanism 40 is connected between the transfer tube 14 and the back portion 44 of the vehicle, for initially providing stationary support to the back portion of the vehicle adjacent to the hull while the first mechanism 28 supports the front portion of the vehicle.

To initiate the actual launch, a third mechanism, the support arm 32, is extended transversely to the longitudinal direction of the cavity and the vehicle, whereby the nose portion 26 is moved outboard of the hull envelope 20, into the external water flow stream 46. At the same time, the ram 40 has a joint 48 which pivots to maintain the back end 44 of the vehicle in, or very close to the cavity. The external flow 46 impinging on the inboard surface of the vehicle facing the cavity, produces an outboard force 55 tending to urge the vehicle nose 26 even farther from the cavity.

At the appropriate pivot angle, the vehicle is released from the clamp 28, so that the vehicle is launched to its target or destination. Preferably, the clamp 28 is controlled so that it automatically releases the front portion 26 of the vehicle when the arm 32 has extended along path 50 a sufficient distance to assure that the nose 26 is outside the launchway cavity 18, as shown in phantom at 52 in FIG. 2. The flow 46 then pivots the torpedo even farther outboard, as shown at 54, where the back end of the vehicle 44 is released from the pivot arm 48.

It should be appreciated that a variety of alternative pivoting mechanisms for supporting the nose portion of the vehicle can be utilized with the present invention. The first support mechanism enables the clamp 28, and thus the nose portion 26, to follow an arcuate path centered around pivot 48, until the vehicle is released. The most efficient way in which to enable the clamp to move both longitudinally during the loading and arming of the vehicle, and then pivotally on an arc in the plane of the sheet of drawing as shown in FIG. 2, is to provide pivot connections 33 between the clamp and the rod 32, and another pivotable connection 37 between the piston cylinder 35 and the cylinder support internal to the hull. It should also be appreciated that arm 32 could alternatively be pivotally connected to a member (not shown) adapted to be hydraulically or otherwise powered to move longitudinally along the direction of arrow 34 on a sliding track in box 36. Those skilled in the art could easily design equivalent implementations actuated by a ball screw with rotary actuator and equivalence.

Figure 3A:
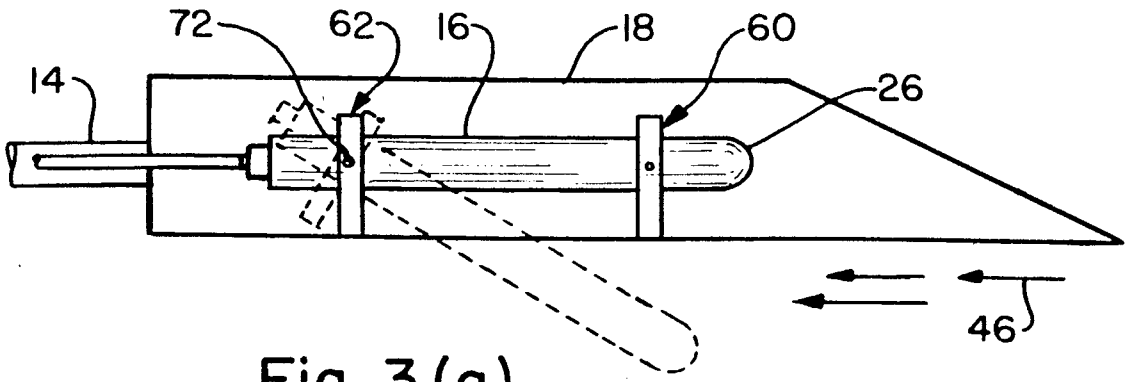
FIGS. 3(*a*) and 3(*b*) are plan and side views of a second embodiment of the invention, wherein the pivot mechanism at the back of the vehicle is in the form of a guide in the cavity, rather than being associated with the tube.
Figure 3B:
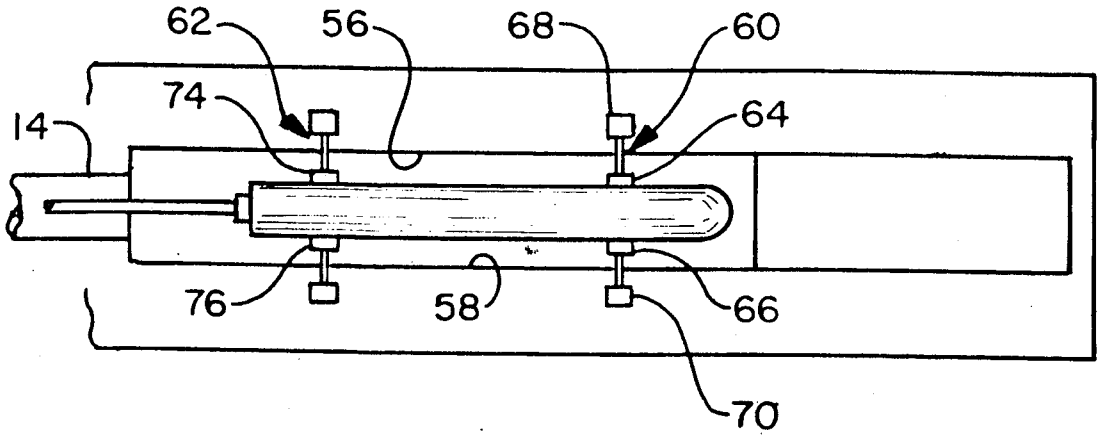

FIG. 3 illustrates a second embodiment of the invention, which is similar to that illustrated in FIG. 2, except that the second mechanism, which holds the rear portion 44 of the vehicle and pivots so that the vehicle can swing out into the flow stream 46, is supported in the cavity lower and upper walls 56,58, rather than through the transfer tube 14. In this embodiment, the vehicle 16 is pushed through the tube 14 into the first and second clamps 60,62 during arming. The clamps 60,62 can take any convenient form, but in the illustrated embodiment, the first, forward clamp 60 has upper and lower clamp pads 64,66 which can be urged toward and away from the vehicle 16 by respective hydraulic or pneumatic cylinders 68,70. The mechanism 60 can be moved transversely to the longitudinal axis of the cavity. The mechanical action of this first clamp mechanism 60 is, first, a movement outboard, thereby swinging the torpedo nose 26 outside into the flow stream, and then a release of the pads 64,67 by retraction away from the torpedo 16.

The second clamping mechanism 62 also has two types of action, the first being a pivoting about axis 72, to accommodate the swinging of the nose 26, and the second being a retraction of pads 74, 76 similar to the second action of the first mechanism 60. In a simplification, the second mechanism 62 could be in the form of a ring or the like, which acts as a passive pivoting guide rather than a true clamp. In this variation, the movement pattern would merely be a pivot of the ring from a first position, for receiving and supporting the vehicle longitudinally along the cavity axis, through a limited pivot which reacts to the positive outboard displacement of the nose 26 by the first mechanism 60.

With either variation of the second embodiment shown in FIG. 3, once the nose 26 is outboard of the cavity and influenced by the flow stream, the vehicle is launched under its own power, or solely by the outboard force exerted by the flow stream 46 acting on the inboard side of the vehicle.

Figure 4:
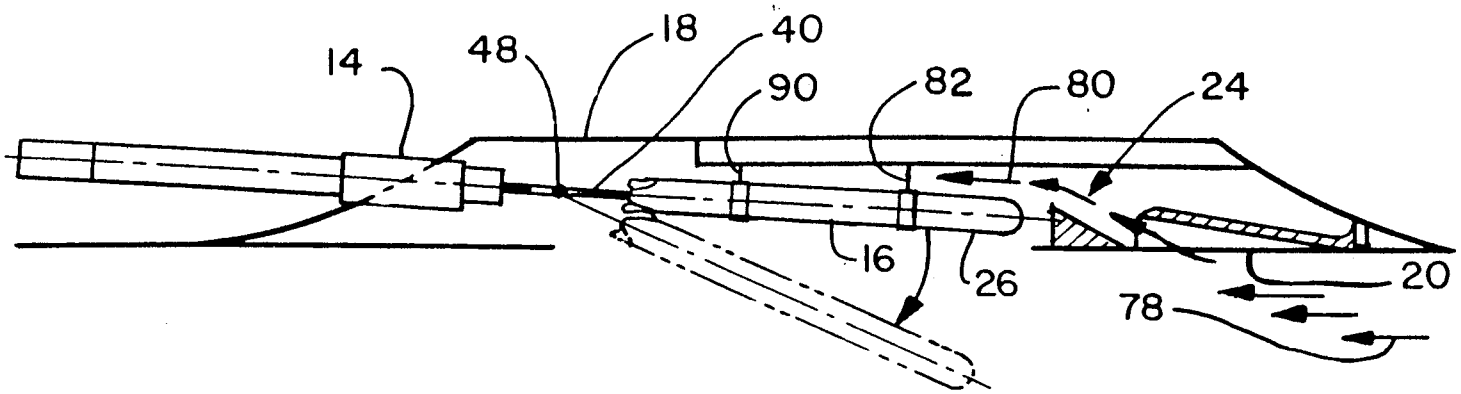
FIGS. 4(*a*) and 4(*b*) are plan and side views of a third embodiment, wherein a dedicated channel which captures and redirects some of the flow stream is utilized to actuate the outboard pivoting of the vehicle prior to launch, and the rear pivot is supported through the tube.
Figure 4B:
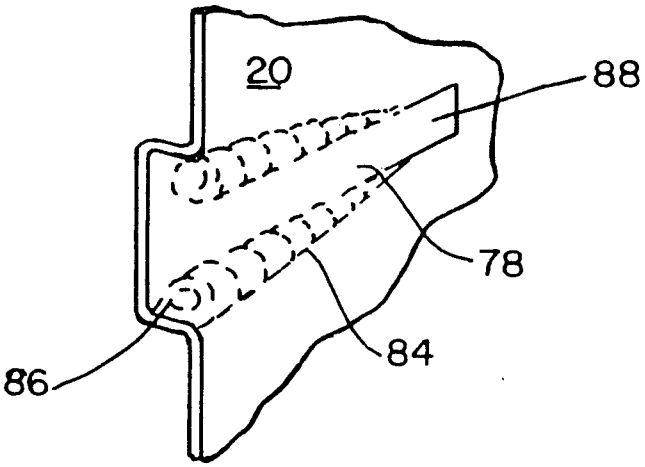

FIGS. 4(*a*) and 4(*b*) illustrate a third embodiment, which is similar to the first embodiment, in that the second support mechanism is the ram 40 with pivot joint 48 supported in the tube 14, but is different from the first embodiment with respect to the manner in which the nose 26 of the vehicle is moved in the outboard direction. In the third embodiment, the function of moving the nose 26 outboard, is provided by a submerged flow channel 24, having a high recovery inlet 78 on the hull surface upstream of the cavity 18, and a discharge 80 into the cavity at a position between the cavity wall and the nose 26 of the supported vehicle. The first support and release mechanism 82 is therefore passive, rather than active. For example, the overall configuration of the first mechanism 82 can be generally similar to the mechanism 60 shown with respect to the second embodiment (FIG. 3(*b*)), except that the pads 64 or guides can merely be spring-loaded with a bias that is relatively light, so that the action of the inboard flow through the channel 24, overcomes the spring bias and pivots the torpedo 16 outwardly. Two such clamps 82, 90 may optionally be provided. FIG. 4(*b*) shows the preferred details of the inlet ramp 78, having sharp edges 84 which create vortices 86 in the diverted flow 88, and capture the momentum and pressure from the flow over the hull.

Figure 5:
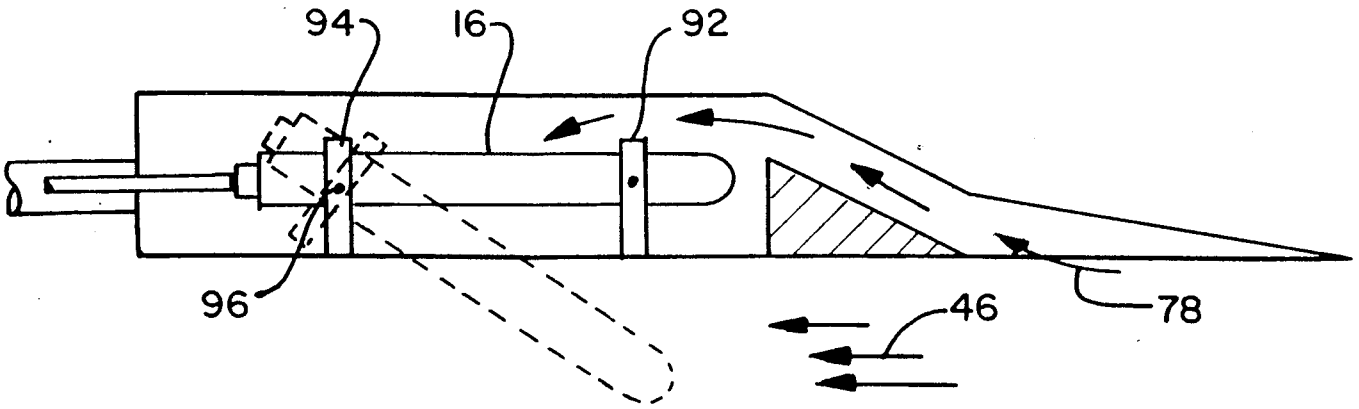
FIG. 5 is a fourth embodiment wherein flow through the dedicated channel is utilized to effectuate the pivoting action, and the pivot at the back of the vehicle is associated with a guide in the cavity.

FIG. 5 illustrates a fourth embodiment of the invention, with a passive first mechanism 92 and a channel 78 that cooperates with the first mechanism for urging the front portion of the torpedo laterally away from the hull, in a manner similar to the corresponding features of the third embodiment. The second mechanism 94, connected between the cavity wall and the back portion of the torpedo, is, however, a passive version of mechanism 62 shown in FIG. 3 for the second embodiment of the invention.

In another embodiment best understood with reference to FIGS. 4(*a*) and 5, the torpedo may be prepositioned in the clamps 82, 90 or 92, 94 and stowed in the cavity recess 18 while the submarine is in port, thus eliminating the need for a torpedo or transfer tube 14. To initiate launch, the forward passive clamps are released, giving the torpedo freedom to rotate in a plane passing through the pivot joint 48 or pivot axis 96. The outboard rotational motion of the torpedo is initiated from flow and pressure developed from the high recovery inlet and channel 78.

It should be appreciated that one of ordinary skill in the art can readily optimize the performance of the various mechanisms for implementing the invention as described generally above. For example, springs can be appropriately utilized for providing a biasing of the passive mechanisms toward the preload, or longitudinal support, position. This biasing would be appropriate, for example, for the pivot 48 in the ram 40 in the first and third embodiment shown in FIG. 2 and 4, respectively, and for the passive pivot guides 62 and 94 of the second and fourth embodiments, shown in FIGS. 3 and 5, respectively. Similarly, various combinations of passive and active mechanisms can be utilized for optimizing the performance in terms of variables such as reliability, speed of operation, minimization of noise, weight, occupied volume, and suitability for retrofitting onto existing hulls.

What is claimed is:

1. A system for launching a vehicle having front and back portions, from the submerged hull of a vessel that is moving forward through water, comprising:

first means carried on a submerged exterior surface of the hull and connected to the front portion of the vehicle, for initially supporting the vehicle front portion adjacent to the hull in the direction of hull travel and then selectively releasing the front portion of the vehicle when the front portion has moved laterally away from the hull;

second means connected between the vessel and the back portion of the vehicle, for initially providing stationary support to the back portion of the vehicle adjacent to the hull while the first means supports the front portion and then providing releasable pivoting support to the back portion as the vehicle front portion moves laterally away from the hull; and third means cooperating with the first means, for urging the front portion laterally away from the hull until the front portion is released by the first means;

whereby the vehicle is released from the first and second means and thereby launched from the hull into the water flowing along the hull.

2. The system of claim 1, wherein the hull includes a launchway formed as an external cavity large enough to receive substantially completely the vehicle as initially supported by the first and second means, and said first means is situated in the launch cavity.

3. The system of claim 2, wherein said third means includes an inlet channel formed in the hull and having a channel entry in front of the launch cavity and a channel discharge in the cavity at a position between the cavity wall and the front portion of the supported vehicle.

4. The system of claim 2, wherein said third means includes displacement means for moving the first means in a direction outboard of the cavity.

5. The system of claim 4, wherein the displacement means is connected to the first means by a pivot joint.

6. The system of claim 4, wherein the displacement means is a first arm which supports the first means and is selectively driven outwardly from the launch cavity.

7. The system of claim 2, wherein the hull includes a transfer tube having an exit end situated in the launch cavity, and the pivot support associated with said second means, is located between the tube exit end and the supported vehicle.

8. The system of claim 2, wherein the second means is supported by the cavity wall.

9. The system of claim 5, wherein the displacement means is supported by a second pivot joint located within the cavity wall.

10. A method for launching a vehicle from the submerged hull of a vessel underway, comprising:

independently supporting the front and back of the vehicle in a submerged cavity of the hull exterior so that the vehicle is oriented substantially parallel with the direction of movement of the vessel;

pivoting the vehicle so that the front moves outboard of the cavity and hull into the water flow streaming along the hull exterior; and launching the vehicle by releasing the front and back of the vehicle after the front is completely in the flow stream.

11. The method of claim 10, wherein the step of pivoting includes directing a flow of water between the cavity wall and the front of the vehicle.

12. The method of claim 10, wherein the step of pivoting includes actuating a mechanical arm member against the vehicle in the outboard direction.

13. The method of claim 10, wherein the step of supporting includes supporting the back portion of the vehicle by a pivot mechanism.

* * * * *